US012234063B2

(12) United States Patent
Zanon et al.

(10) Patent No.: US 12,234,063 B2
(45) Date of Patent: Feb. 25, 2025

(54) LID ASSEMBLY FOR A PACKAGE, LID-SPOUT GROUP FOR A PACKAGE AND PACKAGE HAVING A LID-SPOUT GROUP

(71) Applicant: TETRA LAVAL HOLDINGS & FINANCE S.A., Pully (CH)

(72) Inventors: Paolo Zanon, Modena (IT); Rocco De Paola, Modena (IT); Anna Rosa Vietri, Modena (IT)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 0 days.

(21) Appl. No.: 17/914,119

(22) PCT Filed: Apr. 1, 2021

(86) PCT No.: PCT/EP2021/058621
§ 371 (c)(1),
(2) Date: Sep. 23, 2022

(87) PCT Pub. No.: WO2021/204673
PCT Pub. Date: Oct. 14, 2021

(65) Prior Publication Data

US 2024/0208699 A1 Jun. 27, 2024

(30) Foreign Application Priority Data

Apr. 9, 2020 (EP) ..... 20168903

(51) Int. Cl.
*B65D 47/08* (2006.01)
*B65D 5/74* (2006.01)

(52) U.S. Cl.
CPC ..... *B65D 47/089* (2013.01); *B65D 5/746* (2013.01); *B65D 2251/20* (2013.01); *B65D 2547/066* (2013.01)

(58) Field of Classification Search
None
See application file for complete search history.

(56) References Cited

U.S. PATENT DOCUMENTS 5,785,209 A 7/1998 Guglielmini
11,040,806 B2 * 6/2021 Naumann ..... B65D 41/485
(Continued)

FOREIGN PATENT DOCUMENTS

AU 3556171 A 5/1973
CA 2150590 A1 12/1995
(Continued)

OTHER PUBLICATIONS

International Search Report (PCT/ISA/210) Written Opinion (PCT/ISA/237) mailed on May 26, 2021, by the European Patent Office as the International Searching Authority for International Application No. PCT/EP2021/058621. (9 pages).
(Continued)

*Primary Examiner* — Paul R Durand
*Assistant Examiner* — Michael J. Melaragno
(74) *Attorney, Agent, or Firm* — BUCHANAN INGERSOLL & ROONEY PC

(57) ABSTRACT

A lid assembly comprises a coupling ring, a lid and a connecting unit connecting the lid to the coupling ring. The lid comprises a cover wall configured to cover a pouring outlet and a sealing ring protruding away from the cover wall and configured to interact with a collar carrying the pouring outlet to seal the pouring outlet. The sealing ring comprises at least a first ring portion and a second ring portion. The first ring portion comprises a first end spaced apart from the cover wall and the second ring portion comprises a second end spaced apart from the cover wall. A first distance of the first end from the cover wall with respect to a normal axis of the cover wall is greater than a second
(Continued)

distance of the second end from the cover wall with respect to the normal axis.

20 Claims, 6 Drawing Sheets

(56) References Cited

U.S. PATENT DOCUMENTS

| | | | | |
|---|---|---|---|---|
| 2004/0026465 | A1 | 2/2004 | Klopfer | |
| 2009/0308834 | A1* | 12/2009 | Isogai | B65D 47/106 215/329 |
| 2022/0363447 | A1* | 11/2022 | Sorbara | B65D 55/16 |
| 2023/0044435 | A1* | 2/2023 | Sorbara | B65D 43/164 |
| 2023/0048599 | A1* | 2/2023 | Enemark | B65D 55/16 |

FOREIGN PATENT DOCUMENTS

| | | | | |
|---|---|---|---|---|
| DE | 2155664 | A1 | 6/1972 | |
| EP | 0844190 | A1 | 5/1998 | |
| FR | 2203747 | A1 | 5/1974 | |
| JP | H0423625 | U | 2/1992 | |
| JP | 2010215284 | A | 9/2010 | |
| JP | 2014015250 | A | 1/2014 | |
| JP | 2014231370 | A | 12/2014 | |
| WO | WO-2021204673 | A1 * | 10/2021 | B65D 47/0876 |

OTHER PUBLICATIONS

U.S. Appl. No. 17/913,918, filed Sep. 23, 2022, Davide Morciano et al.

U.S. Appl. No. 17/914,059, filed Sep. 23, 2022, Davide Morciano et al.

U.S. Appl. No. 17/907,170, filed Sep. 23, 2022, Stefano Menozzi et al.

U.S. Appl. No. 17/913,943, filed Sep. 23, 2022, Davide Morciano et al.

U.S. Appl. No. 17/914,025, filed Sep. 23, 2022, Davide Morciano et al.

Office Action/Search Report (First Office Action) issued on Jul. 31, 2024, in corresponding Chinese Patent Application No. 202180009766.4 and English translation of the Office Action/Search Report. (20 pages).

* cited by examiner

LID ASSEMBLY FOR A PACKAGE, LID-SPOUT GROUP FOR A PACKAGE AND PACKAGE HAVING A LID-SPOUT GROUP

TECHNICAL FIELD

The present invention relates to a lid assembly for a spout of a package, in particular a package having a sealed main body, filled with a pourable product, even more particular filled with a pourable food product.

Advantageously, the present invention also relates to a lid-spout group for a package, in particular a package having a sealed main body, filled with a pourable product, even more particular filled with a pourable food product, and having a spout and a lid assembly.

Advantageously, the present invention also relates to a package, in particular a package having a sealed main body, filled with a pourable product, even more particular filled with a pourable food product, and comprising a lid assembly, in particular a lid-spout group.

BACKGROUND ART

As is known, many liquid or pourable food products, such as fruit juice, UHT (ultra-high-temperature treated) milk, wine, tomato sauce, etc., are sold in packages, in particular sealed packages, made of sterilized packaging material.

A typical example is the parallelepiped-shaped package for pourable food products known as Tetra Brik Aseptic (registered trademark), which is made by sealing and folding a laminated strip packaging material. The packaging material has a multilayer structure comprising a carton and/or paper base layer, covered on both sides with layers of heat-seal plastic material, e.g. polyethylene. In the case of aseptic packages for long-storage products, the packaging material also comprises a layer of oxygen-barrier material, e.g. an aluminum foil, which is superimposed on a layer of heat-seal plastic material, and is in turn covered with another layer of heat-seal plastic material forming the inner face of the package eventually contacting the food product.

Some of the known packages, in particular respective sealed main bodies of the packages formed from the packaging material, comprise a designated pour opening, which allows the outpouring of the pourable product from the packages. Typically, the designated pour opening is covered by a separation membrane, which isolates the inside of the package from the outer environment and which is to be opened or to be removed or to be ruptured or to be cut or to be pierced prior to the first outpouring of the pourable product so as to allow for the outpouring of the pourable product through the designated pour opening. It is also known to arrange a lid-spout group having a spout and a lid assembly on the main body about the designated pour opening. The spout has a pouring outlet so as to allow for a controlled outpouring of the pourable product from the package and the lid assembly allows to selectively close and open the pouring outlet.

The spout comprises a collar carrying the pouring outlet.

The lid assembly comprises a coupling ring arranged around the collar, a lid configured to selectively move between a closed configuration and an open configuration in which the lid is configured to respectively close and open the pouring outlet and a connection unit connecting the lid to the coupling ring and defining a hinge axis around which the lid is angularly movable for controlling the lid between the closed configuration and the open configuration.

The lid comprises a cover wall configured to cover the pouring outlet with the lid being in the closed configuration and a sealing ring protruding from the top wall and configured to interact with the collar so as to seal the pouring outlet with the lid being in the closed configuration.

An inconvenience has been found in that in some circumstances and during a movement of the lid from the open configuration to the closed configuration the sealing ring may not correctly engage the collar compromising the correct sealing of the pouring outlet with the lid being in the closed configuration.

Thus, a desire is felt in the sector to provide for a lid assembly, which does not come along with such inconveniences.

In particular, there is a desire felt in the sector to provide for a lid assembly that guarantees the correct sealing of the pouring outlet with the lid being in the closed configuration.

DISCLOSURE OF INVENTION

It is therefore an object of the present invention to provide in a straightforward and low-cost manner an improved lid assembly for a spout of a package, in particular a package having a sealed main body, filled with a pourable product, even more particular filled with a pourable food product.

In particular, it is an object of the present invention to provide in a straightforward and low-cost manner an improved lid assembly for a spout of a package, in particular a packaging having a sealed main body, filled with a pourable product, even more particular filled with a pourable food product, which guarantees a correct sealing of the pouring outlet with the lid being in the closed configuration.

It is a further object of the present invention to provide in a straightforward and low-cost manner an improved lid-spout group for a package, in particular a package having a sealed main body, filled with a pourable product, even more particular filled with a pourable food product.

It is a further object of the present invention to provide in a straightforward and low-cost manner an improved lid-spout group for a package, in particular a package having a sealed main body, filled with a pourable product, even more particular filled with a pourable food product, which guarantees a correct sealing of the pouring outlet with the lid being in the closed configuration.

It is a further object of the present invention to provide in a straightforward and low-cost manner a package, in particular a package having a sealed main body, filled with a pourable product, in particular filled with a pourable food product, having an improved lid assembly, in particular a lid assembly which guarantees a correct sealing of the pouring outlet with the lid being in the closed configuration.

According to the present invention, there is provided a lid assembly according to claim 1.

Further advantageous embodiments of the lid assembly are specified in the claims being directly or indirectly depending on claim 1.

According to the present invention there is also provided a lid-spout group according to claim 14.

According to the present invention, there is also provided a package according to claim 15.

BRIEF DESCRIPTION OF THE DRAWINGS

A non-limiting embodiment of the present invention will be described by way of example with reference to the accompanying drawings, in which.

BEST MODES FOR CARRYING OUT THE INVENTION

Figure 1:
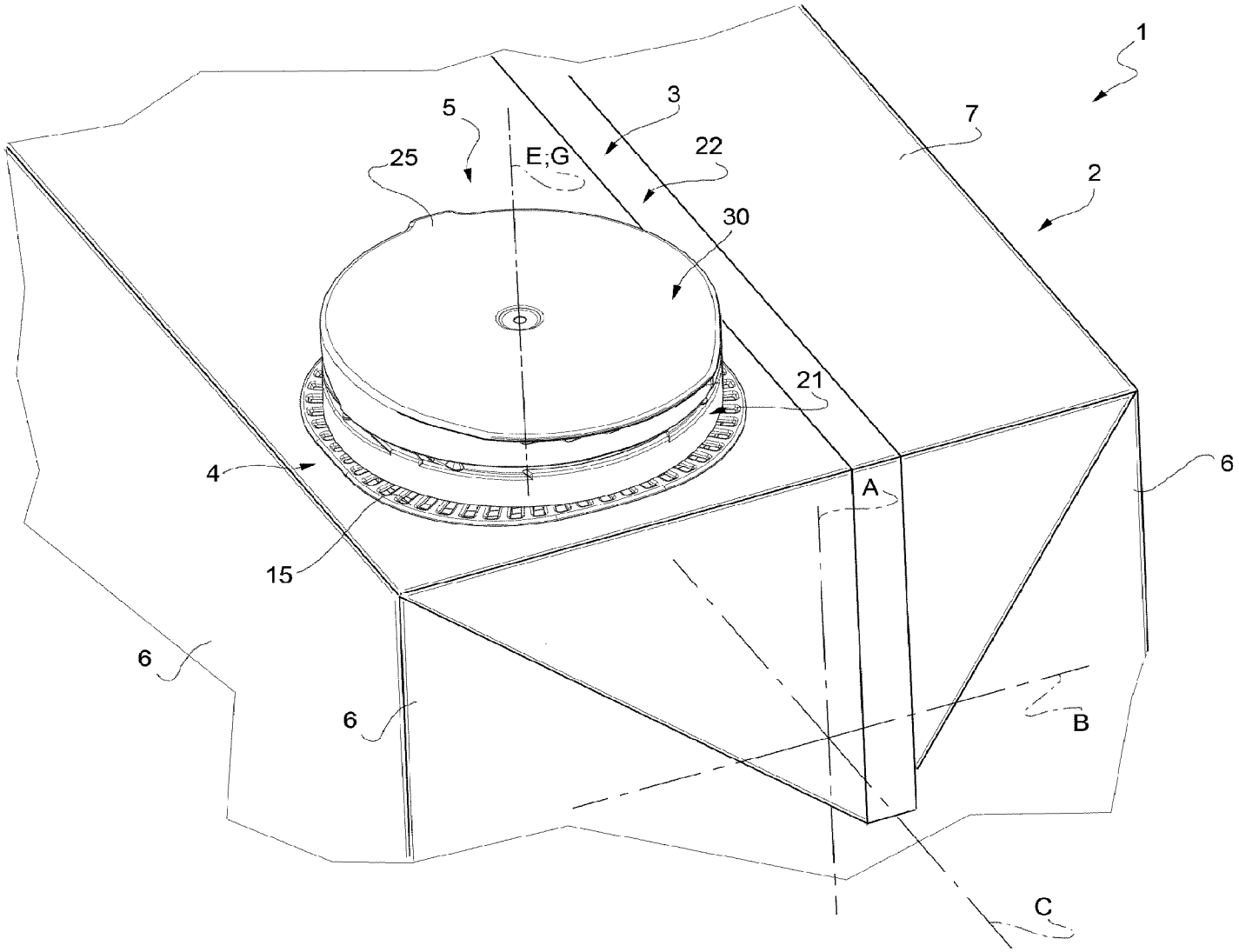
FIG. 1 is a schematic perspective view of a portion of a package having a lid assembly according to the present invention and being in a first configuration, with parts removed for clarity.

Number 1 indicates as a whole a package (only partially shown to the extent necessary for the comprehension of the present invention) comprising:

- a sealed main body 2, in particular a sealed carton package, being filled with a pourable product, in particular a pourable food product, and in particular having a designated pour opening configured to allow for an outflow of the pourable product from main body 2; and
- a lid-spout group 3 coupled to the sealed main body 2 and having at least a spout 4 arranged and/or arrangeable about the designated pour opening and a lid assembly 5 coupled and/or couplable to spout 4.

According to some preferred non-limiting embodiments, main body 2 is obtained from a packaging material, in particular a composite packaging material, having a multilayer structure (not shown and known as such).

Preferentially, the packaging material is provided in the form of a web.

Preferentially, main body 2 is obtained by forming a tube from the packaging material, longitudinally sealing the tube, filling the tube with the pourable product and by transversally sealing and cutting the tube.

Preferentially, the packaging material comprises at least a layer of fibrous material, such as e.g. paper or cardboard, and at least two layers of heat-seal plastic material, e.g. polyethylene, interposing the layer of fibrous material in between one another. One of these two layers of heat-seal plastic material defining the inner face of main body 2 contacting the pourable product.

Preferably, the packaging material also comprises a layer of gas- and light-barrier material, e.g. aluminum foil or ethylene vinyl alcohol (EVOH) film, in particular being arranged between one of the layers of the heat-seal plastic material and the layer of fibrous material. Preferentially but not necessarily, the packaging material also comprises a further layer of heat-seal plastic material being interposed between the layer of gas- and light-barrier material and the layer of fibrous material.

According to a preferred non-limiting embodiment, spout(s) 4 is(are) applied to base package(s) 2 prior, during or after the formation, filling and sealing of main body(ies) 2.

Alternatively, spout(s) 4 can be applied onto the packaging material prior to arranging the packaging material within or during advancement of the packaging material through a packaging machine for forming, filling and sealing main bodies 2 from the packaging material.

In particular, application of spout(s) 4 to the packaging material or to main body 2 occurs by means of a molding process and/or adhesive bonding and/or ultrasonic bonding.

Preferentially, lid assembly 5 is coupled to spout 4 prior or after application of spout 4 onto main body 2 or onto the packaging material.

According to some preferred non-limiting embodiments, spout 4 and lid assembly 5 are obtained, in particular molded, from a polymeric material.

With particular reference to FIG. 1, main body 2 extends along a longitudinal axis A, a first transversal axis B and a second transversal axis C. In particular, the extension of package 2 along longitudinal axis A is larger than the extension of package 2 along first transversal axis B and second transversal axis C.

Preferentially, main body 2 is parallelepiped-shaped.

According to some preferred non-limiting embodiments, main body 2 comprises a first wall portion (not shown and known as such), in particular being transversal, even more particular perpendicular, to axis A, from which main body 2 extends along axis A. Preferably, the first wall portion defines a support wall of package 1, in particular main body 2, which is designed to be put in contact with a support surface, such as e.g. a shelf, when, in use, being e.g. exposed within a sales point or when being stored. In particular, when being arranged on a support surface the first wall portion defines a bottom wall portion.

Preferably, main body 2 also comprises a plurality of lateral walls 6 being (fixedly) connected to the first wall portion and extending, in particular substantially parallel to axis A, from the first wall portion.

Preferably, main body 2 also comprises a second wall portion 7 opposite to the first wall portion and being (fixedly) connected to at least some of lateral walls 6. In particular, lateral walls 6 are interposed between the first wall portion and second wall portion 7. In particular, when being arranged on a support, second wall portion 7 defines a cover wall portion.

According to some non-limiting embodiments, the first wall portion and second wall portion 7 may be parallel to one another.

According to a non-limiting alternative embodiment not shown, the first wall portion and second wall portion 7 could be inclined with respect to one another.

According to some non-limiting embodiments, second wall portion 7 carries and/or comprises the designated pour opening.

According to some preferred non-limiting embodiments, package 1, in particular main body 2, comprises an inner space configured to contain and/or containing the pourable product. In particular, the first wall portion, lateral walls 6 and second wall portion 7 delimit the inner space.

According to a preferred non-limiting embodiment, main body 2 comprises a separation membrane (not shown and known as such) covering the designated pour opening. In particular, the separation membrane separates in the area of, in particular at, the designated pour opening the inner space from the outer environment. Preferentially, the separation membrane comprises a gas- and light-barrier material, e.g. aluminum foil or ethylene vinyl alcohol (EVOH) film.

In particular, during the first-time use (see further below for more details), the separation membrane is at least partially removed and/or ruptured and/or opened and/or cut and/or pierced for allowing the pourable product to flow out of the inner space and main body 2.

According to a preferred non-limiting embodiment, the separation membrane is defined by a portion of the packaging material, in particular a portion of the layers of the packaging material being different from the layer of fibrous material.

With particular reference to FIGS. 1, 2, 5 and 6, spout 4 comprises at least:

a pouring outlet 12 configured to allow for the outflow of the pourable product from package 1; and a collar 13 carrying (comprising) pouring outlet 12.

Preferentially, spout 4 also comprises a base frame 15 coupling and/or configured to couple spout 4 to main body 2, in particular to second wall portion 7, about the designated pour opening.

In more detail, collar 13 extends along a longitudinal axis E, in particular parallel to axis A, and carries (comprises) pouring outlet 12 at a first axial end of collar 13 itself and an inlet opening for the pourable product at a second axial end of collar 13 itself opposite to the first axial end.

In particular, collar 13 delimits (and/or comprises) a flow channel 17 for the pourable product extending between the inlet opening and pouring outlet 12. In use, collar 13 is configured such to receive the pourable product from the inner space through the inlet opening and such that the pourable product flows out of pouring outlet 12.

In particular, collar 13 comprises a rim 18 delimiting pouring outlet 12, and in particular being arranged at the first axial end.

Preferentially, collar 13 comprises an inner surface 19 delimiting flow channel 17.

Even more preferentially, collar 13 also comprises an outer surface 20 opposite to inner surface 19.

In particular, collar 13 presents a tubular configuration.

Even more particular, collar 13 presents an annular cross-sectional profile with respect to a cross-sectional plane perpendicular to longitudinal axis E.

With particular reference to FIGS. 1 to 6, lid assembly 5 comprises at least:

a coupling ring 21 arrangeable and/or arranged around a portion of spout 4, in particular collar 13;

a lid 22 configured to selectively close and open a pouring outlet of the spout; and a connecting unit 23 connecting lid 22 to coupling ring 21.

According to some preferred non-limiting embodiments, connecting unit 23 hinges lid 22 to coupling ring 11. In particular, lid 22 is angularly moveable around a hinge axis F, in particular transversal to longitudinal axis E with lid 22 being coupled to spout 4, defined by connecting unit 23.

Figure 2:
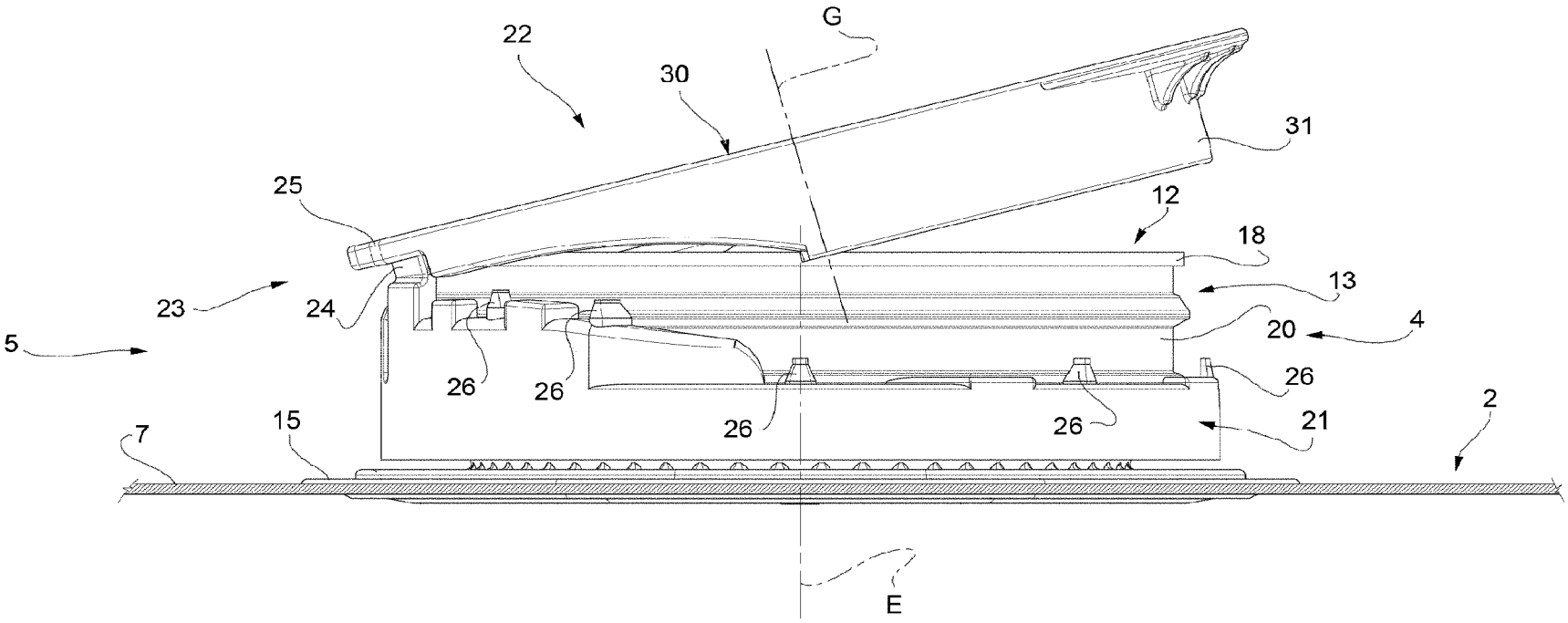
FIG. 2 is a lateral view of the lid assembly of FIG. 1 being in a second configuration, with parts removed for clarity.
Figure 3:
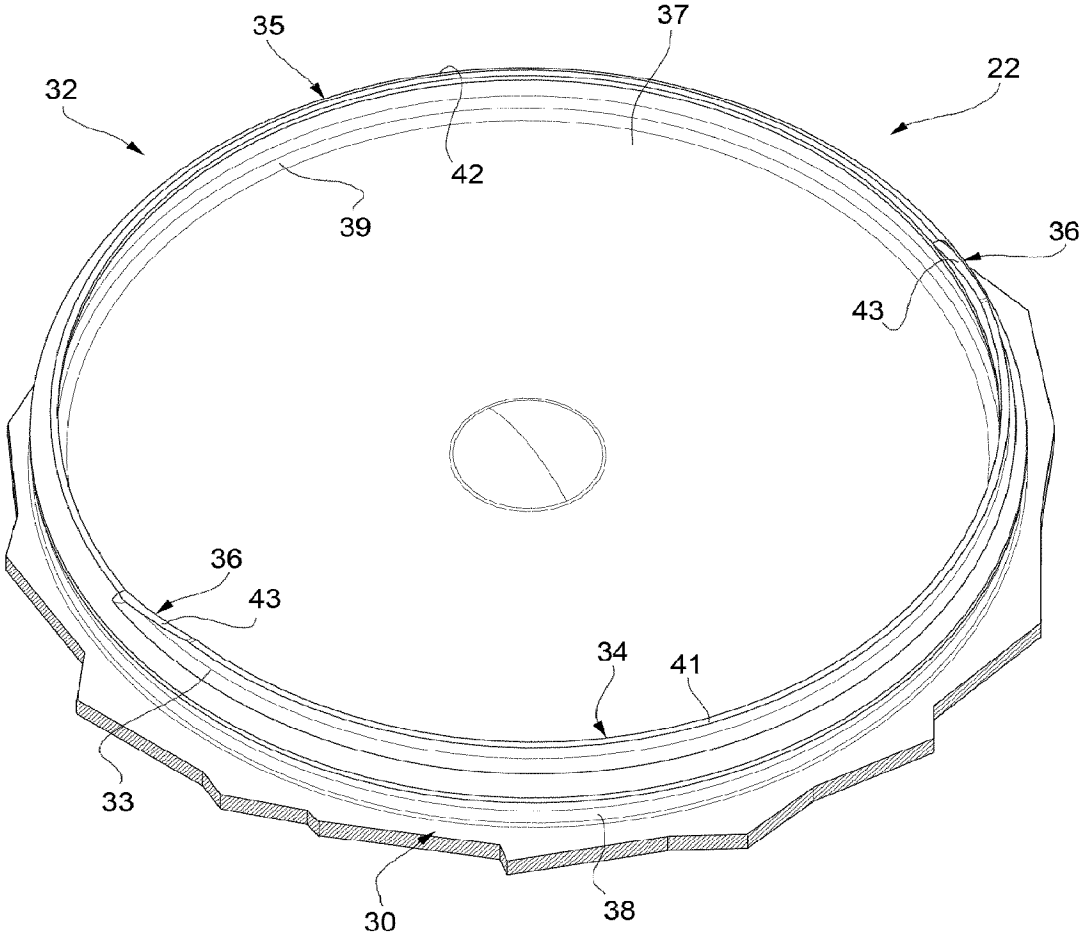
FIG. 3 is a perspective bottom view of details of the lid assembly of FIG. 1, with parts removed for clarity.
Figure 4:
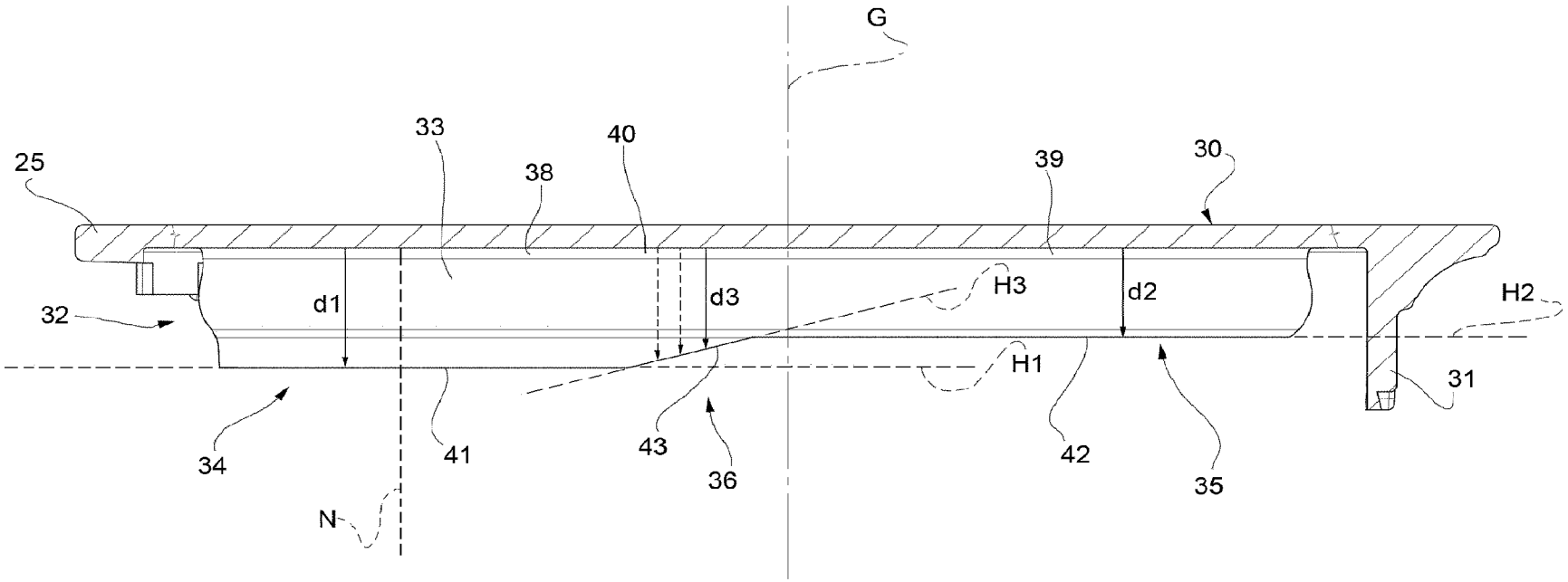
FIG. 4 is a partially sectionized side view of some details of the lid assembly of FIG. 1, with parts removed for clarity.
Figure 5:
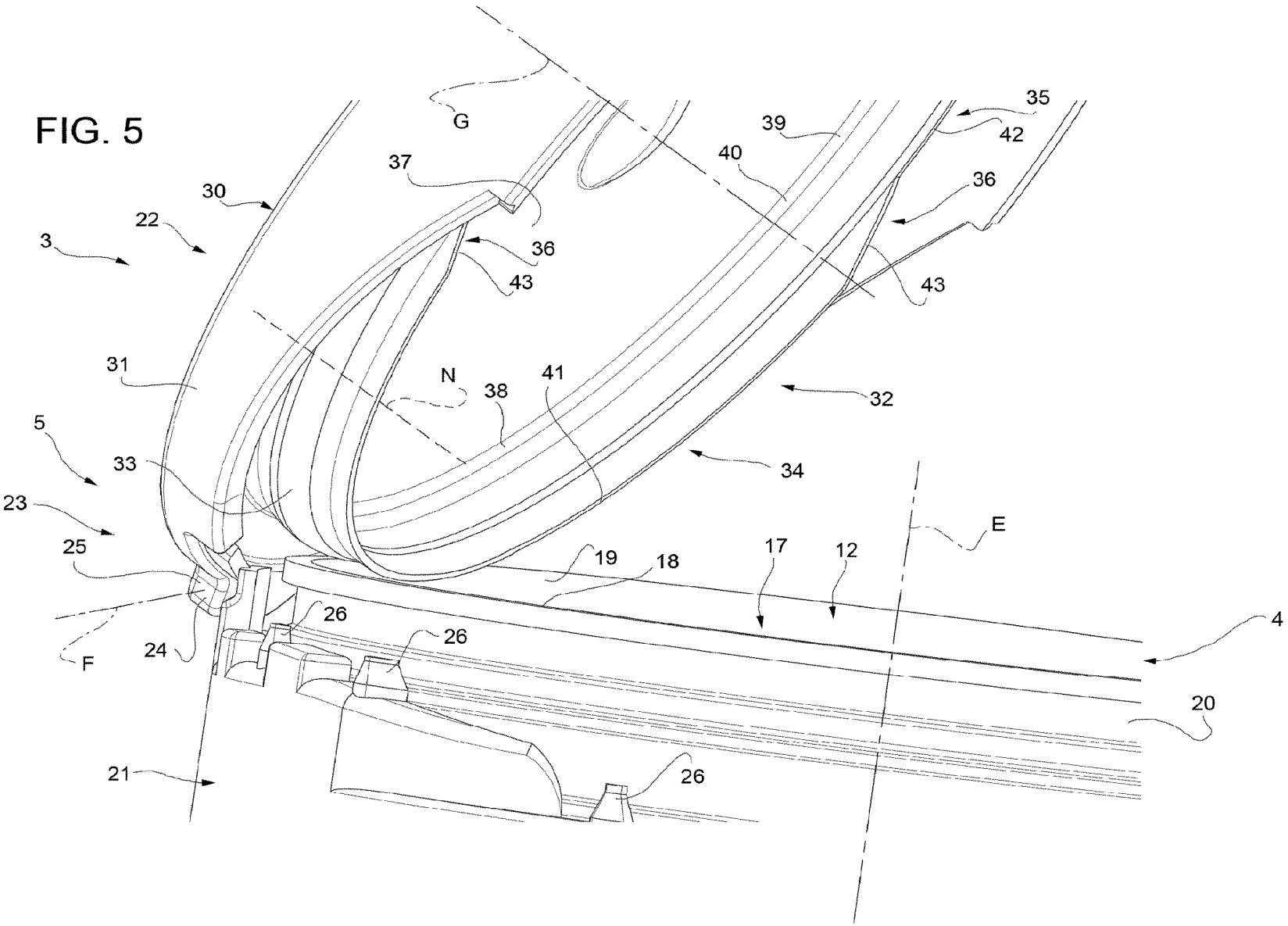
FIG. 5 is an enlarged perspective view of details of the lid assembly of FIG. 1 being in a third configuration, with parts removed for clarity.
Figure 6:
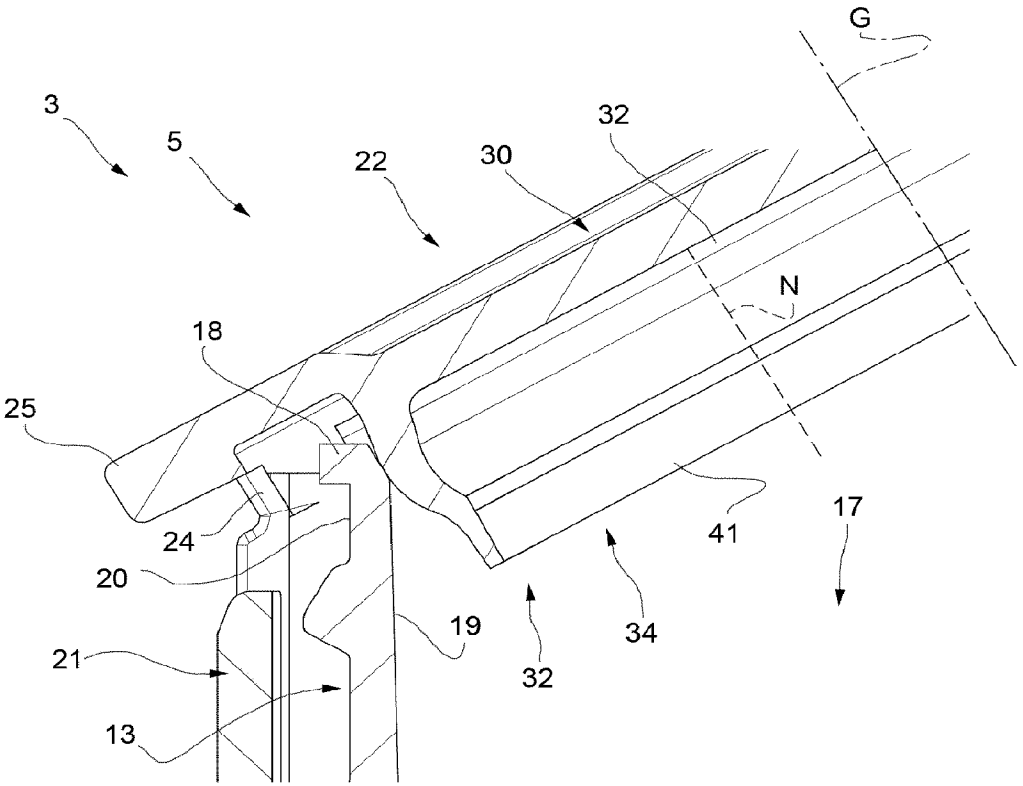
FIG. 6 is a partially sectionized side view of some details of the lid assembly of FIG. 1, with parts removed for clarity.

With particular reference to FIGS. 2, 5 and 6, connecting unit 23 comprises one or more coupling elements 24, in the specific non-limiting embodiment two coupling elements (even though only one is visible in the Figures), fixed to and protruding from coupling ring 21 and being connected to lid 22. In particular, coupling elements 24 are designed such to define hinge axis F and to allow the angular movement of lid 22 around hinge axis F.

According to some preferred non-limiting embodiments, connecting unit 23 is, in particular coupling elements 24 are, connected to a contact portion 25 of lid 22. In particular, contact portion 25 defines a rear portion of lid 22, i.e. contact portion 25 faces away from a user at least the first time lid 22 is moved from the closed configuration to the open configuration.

Preferentially, lid assembly 5 also comprises rupturable coupling bridges 26 connecting coupling ring 21 and lid 22 with one another. Coupling bridges 26 are designed to irreversibly rupture during the first control of lid 22 from the closed configuration to the open configuration.

According to some preferred non-limiting embodiments, lid assembly 5 also comprises an opening arrangement (not shown and known as such), preferentially operatively coupled to lid 22, and configured to at least partially open and/or cut and/or rupture and/or remove the separation membrane during the first time lid 22 is controlled from the closing configuration to the open configuration.

According to some non-limiting embodiments, the opening arrangement comprises a (polymer) covering layer fused to and/or connected to and/or partially defining the separation membrane and a coupling member connected to the covering layer and lid 22. In use, the first time lid 22 is controlled from the closed configuration to the open configuration the angular movement of lid 22 around hinge axis F also leads to an angular movement of the covering layer and the separation membrane around hinge axis F.

Alternatively, the opening arrangement could be in the form of a cutter or a strapping element connected to and/or fused to and/or at least partially defining the separation membrane and which the consumer needs to manually remove from main body 2.

According to some preferred non-limiting embodiments, lid 22 is controllable between at least:

a closed configuration, in which lid 22 is configured to cover and/or covers pouring outlet 12, in particular for impeding an outflow of the pourable product out of pouring outlet 12; and an open configuration in which lid 22 is configured to be and/or is detached from pouring outlet 12, in particular for allowing an outflow of the pourable product through pouring outlet 12.

Preferentially, lid 22 is moveable between at least an active angular position and a rest angular position around hinge axis F in which lid 22 is controlled in respectively the closed configuration and the open configuration.

According to some preferred non-limiting embodiments, lid 22 comprises a cover wall 30 configured to cover the pouring outlet with lid 22 being arranged in the closed configuration and a side wall 31 protruding from cover wall 30 and being configured to at least partially surround collar 13 with lid 22 being arranged in the closed configuration.

Preferentially, cover wall 30 and side wall 31 delimit an internal space having a (substantially) cylindrical shape. In particular, the internal space houses, with lid 22 being arranged in the closed configuration, at least a portion of collar 13 and flow channel 17.

Advantageously, lid 22 further comprises a sealing ring 32 protruding away from, and in particular being connected to, cover wall 30 and configured to interact with collar 13 so as to seal pouring outlet 12 with lid 22 being in the closed configuration.

In particular, sealing ring 32 is configured to at least partially protrude into flow channel 17 and to engage inner surface 19 with lid 22 being in the closed configuration. In other words, a portion of cover wall 30 being enclosed by sealing ring 32 and sealing ring 32 itself define an active cap being partially arranged within flow channel 17 and sealing in cooperation with one another pouring outlet 12 with lid being in the closed configuration.

It should be noted that sealing ring 32 contributes to the sealing of pouring outlet 12 together with a portion of cover wall 30. Indeed, sealing ring 32 is configured to seal a peripheral portion of pouring outlet 12, in particular at rim 18. In particular, sealing ring 32 is configured to abut against inner surface 19, in particular at rim 18, so as to avoid any lateral leakage of the pourable product.

Preferentially, sealing ring 32 comprises an outer surface 33 configured to engage inner surface 19 with lid 22 being in the closed configuration.

In particular, an outer diameter of sealing ring 32 (substantially) equals an inner diameter of collar 13, in particular of rim 18.

In particular, sealing ring 32 is at least partially surrounded by side wall 31.

Preferentially, sealing ring 32 is connected to an inner surface 37 of cover wall 30, inner surface 37 facing flow channel 17 with lid 22 being arranged in the closed configuration.

Advantageously, sealing ring 32 comprises at least a first ring portion 34, a second ring portion 35, and in particular one or more intermediate portions 36, in the specific case shown two intermediate portions, connecting first ring portion 34 and second ring portion 35 with one another.

Preferentially, first ring portion 34 comprises a first contact end 38, second ring portion 35 comprises a second contact end 39, and in particular each intermediate ring portions 36 comprises a respective third contact end 40. In particular, first contact end 38, second contact end 39, and in particular third contact end 40, are connected to cover wall 30, in particular inner surface 37.

Preferentially, first ring portion 34 further comprises a first end 41 spaced apart from cover wall 30, in particular inner surface 37, and opposite to first contact end 38 and second ring portion 35 further comprises a second end 42 spaced apart from cover wall 30, in particular inner surface 37, and opposite to second contact end 39. Even more preferentially, each intermediate ring portion 36 further comprises a respective third end 43 spaced apart from cover wall 30, in particular inner surface 37, and opposite to the respective third contact end 40.

According to some preferred non-limiting embodiments, first ring portion 34 is closer to contact portion 25 than second ring portion 35. In other words, first ring portion 34 is interposed between contact portion 25 and second ring portion 35.

Advantageously, a first distance d1 of first end 41 from cover wall 30, in particular inner surface 37, with respect to a normal axis N of cover wall 30, in particular inner surface 37, is greater than a second distance d2 of second end 42 from cover wall 30, in particular inner surface 37, with respect to normal axis N.

It should be noted that normal axis N is by definition perpendicular to and extends from cover wall 30, in particular inner surface 37.

Preferentially, a third distance d3 between each third end 43 and cover wall 30, in particular inner surface 37, with respect to normal axis N is intermediate between first distance d1 and second distance d2.

Preferentially, first end 41 extends in a first plane H1 and second end 42 extends in a second plane H2 spaced apart from first plane H1. Even more preferentially, first plane H1 and second plane H2 are parallel to one another, and in particular parallel to cover wall 30, in particular inner surface 37.

Preferentially, first plane H1 and second plane H2 are transversal, in particular perpendicular to normal axis N.

Preferentially, second plane H2 is interposed between cover wall 30 and first plane H1.

In particular, a distance between first plane H1 and cover wall 30 corresponds to first distance d1 and a distance between second plane H2 and cover wall 30 corresponds to second distance d2.

According to some preferred non-limiting embodiments, each third end 43 extends in a third plane H3 transversal to first plane H1 and second plane H2.

According to some preferred non-limiting embodiments, first contact end 38, second contact end 39, and in particular also each third contact end 40, extend in a respective common plane. In particular, inner surface 37 extends in the common plane.

According to some preferred non-limiting embodiments, lid 22 comprises a central axis G. In particular, central axis G is parallel, even more particular coaxial, to longitudinal axis E with lid 22 being in the closed configuration.

Preferentially, first ring portion 34 extends from a first angular position to a second angular position with respect to central axis G and second ring portion 35 extends from a third angular position to a fourth angular position with respect to central axis G. Even more particular, at least one intermediate ring portion 36 extends from the first angular position to the fourth angular position and at least another intermediate ring portion 36 extends from the second angular position to the third angular position with respect to central axis G.

According to some preferred non-limiting embodiments, first distance d1 is constant between the first angular position and the second angular position with respect to central axis G and/or second distance d2 is constant between the third angular position and the fourth angular position with respect to central axis G.

Preferentially, each third distance d3 varies continuously between respectively the second angular position and the third angular position and the fourth angular position and the first angular position.

According to some preferred non-limiting embodiments, contact portion 25 extends between a first angular contact position and a second angular contact position with respect to central axis G. In particular, the first angular contact position and the second angular contact position are interposed between the first angular position and the second angular position.

In use, a user receives package 1 with lid 22 being in the closed configuration so as to seal pouring outlet 12 and to impede the pourable product to leave pouring outlet 12. In particular, sealing is obtained by cover wall 30 and sealing ring 32 engaging collar 13, in particular inner surface 19.

In order to allow for the outpouring of the pouring outlet 12, lid 22 needs to be controlled from the closed configuration to the open configuration. The first time lid 22 is controlled from the closed configuration to the open configuration coupling bridges 26 irreversibly rupture and the opening arrangement at least partially removes and/or opens and/or cuts and/or ruptures and/or pierces the separation membrane.

Afterwards, it is again possible to control lid 22 from the open configuration to the closed configuration. Thereby, owing to first ring portion 34 the correct arrangement of sealing ring 32 with respect to collar 13 is guaranteed.

The advantages of lid assembly 5 and/or lid-spout group 3 and/or of package 1 according to the present invention will be clear from the foregoing description.

In particular, by dividing sealing ring 32 into at least first ring portion 34 and second ring portion 35 it is guaranteed that during control of lid 22 from the open configuration to the closed configuration sealing ring 32 is correctly arranged with respect to collar 13. In particular, it is guaranteed that sealing ring 32 at least partially enters into flow channel 17 and that outer surface 33 abuts against inner surface 19.

Clearly, changes may be made to lid assembly 5 and/or lid-spout group 3 and/or package 1 as described herein without, however, departing from the scope of protection as defined in the accompanying claims.

The invention claimed is:

1. Package filled with a pourable product, the package comprising:

a sealed main body containing the pourable product and having a top wall provided with a designated pour opening configured to allow outflow of the pourable product from the main body to dispense the pourable product from the main body, the main body being comprised of a multilayer structure;

a spout fixed to the top wall of the main body and arranged about the designated pour opening, the spout projecting upwardly away from an outer surface of the top wall of the main body, the spout having a pouring outlet through which the pourable product flows as the pourable product is being dispensed from the main body;

a coupling ring surrounding a portion of the spout;

a lid positioned in a closed configuration in which the lid covers and closes the pouring outlet of the spout and movable away from the spout to an open configuration in which the pouring outlet of the spout is open;

a connecting unit connecting the lid to the coupling ring in a manner allowing the lid to move from the closed configuration to the open configuration, and from the open configuration to the closed configuration;

the lid comprising a cover wall that covers the pouring outlet;

the lid comprising a sealing ring that protrudes away from the cover wall and interacts with spout to seal the pouring outlet;

the sealing ring comprising at least a first ring portion and a second ring portion;

the first ring portion comprising a first end spaced apart from the cover wall and the second ring portion comprising a second end spaced apart from the cover wall; and a first distance of the first end from the cover wall with respect to a normal axis of the cover wall is greater than a second distance of the second end from the cover wall with respect to the normal axis.

2. Package according to claim 1, wherein the first end extends in a first plane and the second end extends in a second plane spaced apart from the first plane.

3. Package according to claim 2, wherein the second plane is interposed between the cover wall and the first plane.

4. Package according to claim 2, wherein the first plane and the second plan are transversal to the normal axis;

wherein the first plane and the second plane are parallel to one another.

5. Package according to claim 2, wherein the first plane and the second plane are perpendicular to the normal axis, and the first plane and the second plane are parallel to one another.

6. Package according to claim 1, wherein the sealing ring comprises at least one intermediate ring portion connecting the first ring portion and the second ring portion with one another;

wherein the intermediate ring portion comprises a third end opposite to the cover wall;

wherein a third distance of the intermediate ring portion from the cover wall with respect to the normal axis is intermediate between the first distance and the second distance.

7. Package according to claim 1, wherein the sealing ring comprises an outer surface engages an inner surface of the collar.

8. Package according to claim 1, wherein the collar delimits a flow channel for the pourable product;

wherein the sealing ring protrudes at least partially into the flow channel.

9. Package according to claim 1, wherein the lid comprises a central axis;

wherein the first ring portion extends from a first angular position to a second angular position with respect to the central axis and the second ring portion extends from a third angular position to a fourth angular position with respect to the central axis.

10. Package according to claim 9, wherein the connecting unit contacts the lid at a contact portion of the lid;

wherein the contact portion extends between a first angular contact position and a second angular contact position with respect to the central axis;

wherein the first angular contact position and the second angular contact position is interposed between the first angular position and the second angular position.

11. Package according to claim 1, wherein the connecting unit contacts the lid at a contact portion of the lid;

wherein the first ring portion is closer to the contact portion than the second ring portion.

12. Package according to claim 1, wherein the connection unit defines a hinge axis around which the lid is angularly movable;

wherein the lid is in an active angular position and a rest angular position with respect to the hinge axis when being in respectively the closed configuration and the open configuration.

13. Package according to claim 1, wherein the first ring portion comprises a first contact end contacting the cover wall and being opposite to the first end and the second ring portion comprises a second contact end contacting the cover wall.

14. Package according to claim 13, wherein the first contact end and the second contact end lie on a common plane.

15. Package filled with a pourable product, the package comprising:

a sealed main body containing the pourable product and having a top wall provided with a designated pour opening configured to allow outflow of the pourable product from the main body to dispense the pourable product from the main body, the main body being comprised of a multilayer structure, the top wall having an outer surface facing away from the pourable product;

a spout fixed to the top wall of the main body by a molding process and/or adhesive bonding and/or ultrasonic bonding, the spout projecting away from the outer surface of the top wall of the main body so that the spout is an upstanding spout, the upstanding spout being arranged about the designated pour opening and comprising a pouring outlet through which the pourable product flows as the pourable product is being dispensed from the main body, the upstanding spout that is fixed to the top wall of the main body also having an inner surface surrounded by the upstanding spout;

a coupling ring surrounding a portion of the spout;

a lid comprised of a cover wall, a side wall projecting from the cover wall and a sealing ring projecting from the cover wall and at least partially surrounded by the side wall, the lid being in a closed configuration in which: i) the cover wall of the lid covers and closes the pouring outlet of the upstanding spout; ii) the sealing ring contacts the inner surface of the upstanding spout to seal the pouring outlet of the upstanding spout; and iii) the side wall at least partially surrounds the upstanding spout so that an inner surface of the side wall faces an outer surface of the upstanding spout, the lid being movable from the closed configuration to an open configuration in which the cover wall is spaced from the pouring outlet of the upstanding spout so that the pouring outlet of the upstanding spout is open;

a connecting unit connecting the lid to the coupling ring in a manner allowing the lid to move from the closed configuration to the open configuration, and from the open configuration to the closed configuration;

the sealing ring comprising a first ring portion and a second ring portion;

the first ring portion comprising a first end spaced apart from the cover wall and the second ring portion comprising a second end spaced apart from the cover wall; and the first end of the first ring portion being spaced from the cover wall of the lid by a first distance as measured along a normal axis that is normal to the cover wall, the second end of the second ring portion being spaced from the cover wall of the lid by a second distance as measured along the normal axis, the first distance being greater than the second distance.

16. Package according to claim 15, wherein the first end of the first ring portion is located in a first plane and the second end of the second ring portion is located in a second plane, the first and second planes being spaced apart from one another.

17. Package according to claim 16, wherein the second plane is located between the cover wall and the first plane.

18. Package according to claim 15, wherein the sealing ring comprises at least one intermediate ring portion connecting the first ring portion and the second ring portion to one another, the intermediate ring portion comprising a third end spaced apart from the cover wall, the third end of the intermediate ring portion being spaced from the cover wall of the lid by a third distance as measured along the normal axis, the third distance being less than the first distance and greater than the second distance.

19. Package according to claim 18, wherein the first and second planes are parallel to one another, the third end of the intermediate ring portion being located in a third plane that intersects the first and second planes.

20. Package according to claim 15, wherein the lid comprises a central axis, the first ring portion extending from a first angular position to a second angular position with respect to the central axis, the second ring portion extending from a third angular position to a fourth angular position with respect to the central axis.

* * * * *